US006438768B1

(12) United States Patent
Yen

(10) Patent No.: US 6,438,768 B1
(45) Date of Patent: Aug. 27, 2002

(54) FOOT SPA APPARATUS

(76) Inventor: Yen-Jen Yen, No. 22-1, Lane 3, Haochin Rd., Nanhsin Tsun, Yenpu Hsiang, Changhua County (TW)

( * ) Notice: Subject to any disclaimer, the term of this patent is extended or adjusted under 35 U.S.C. 154(b) by 0 days.

(21) Appl. No.: 09/942,651

(22) Filed: Aug. 31, 2001

(51) Int. Cl.[7] ..... E03C 1/00
(52) U.S. Cl. ..... 4/622; 601/166
(58) Field of Search ..... 4/622; 601/158, 601/160, 166

(56) References Cited

U.S. PATENT DOCUMENTS 2,988,754 A * 6/1961 Misson ..... 4/622
3,965,495 A * 6/1976 McNair ..... 4/622
2002/0013964 A1 * 2/2002 Kuen ..... 4/622
2002/0016990 A1 * 2/2002 Ferber ..... 4/622

* cited by examiner

*Primary Examiner*—Charles E. Phillips
(74) *Attorney, Agent, or Firm*—Rosenberg, Klein & Lee

(57) ABSTRACT

A foot spa apparatus is constructed to include a base holding a container, a water pump adapted to pump water from the container to horizontal spray tubes and a vertical nozzle tube to stimulate the sole of the foot and lower pat of the user's legs, a collapsible fence wall provided at the top of the container around the water chamber in the container and adjusted to the desired height, and an electric heating coil adapted to heat water in the container.

5 Claims, 5 Drawing Sheets

FOOT SPA APPARATUS

BACKGROUND OF THE INVENTION

The present invention relates to a foot spa apparatus, and more particularly, to such a foot spa apparatus, which can stimulate and massage the sole of the foot as well as the calf of the leg with compressed hot water.

Various foot spa apparatus have been disclosed, and have appeared on the market. These conventional foot spa apparatus commonly have a fixed size, not adjustable in height. Further, these conventional foot spa apparatus are not applicable to stimulate the muscles of the calf of the leg.

SUMMARY OF THE INVENTION

The present invention has been accomplished to provide a foot spa apparatus, which eliminates the aforesaid drawbacks. According to one aspect of the present invention, the foot spa apparatus has a collapsible fence wall that can be adjusted to different heights to hold different volume of water in the container of the foot spa apparatus. According to another aspect of the present invention, the foot spa apparatus has horizontal spray tubes and a vertical nozzle tube for output of compressed hot water to stimulate the sole of the foot as well as the calf of the leg. According to still another aspect of the present invention, the foot spa apparatus has electric heater means adapted to heat water in the container of the foot spa apparatus to the desired temperature level.

DETAILED DESCRIPTION OF THE PREFERRED EMBODIMENT

Figure 1:
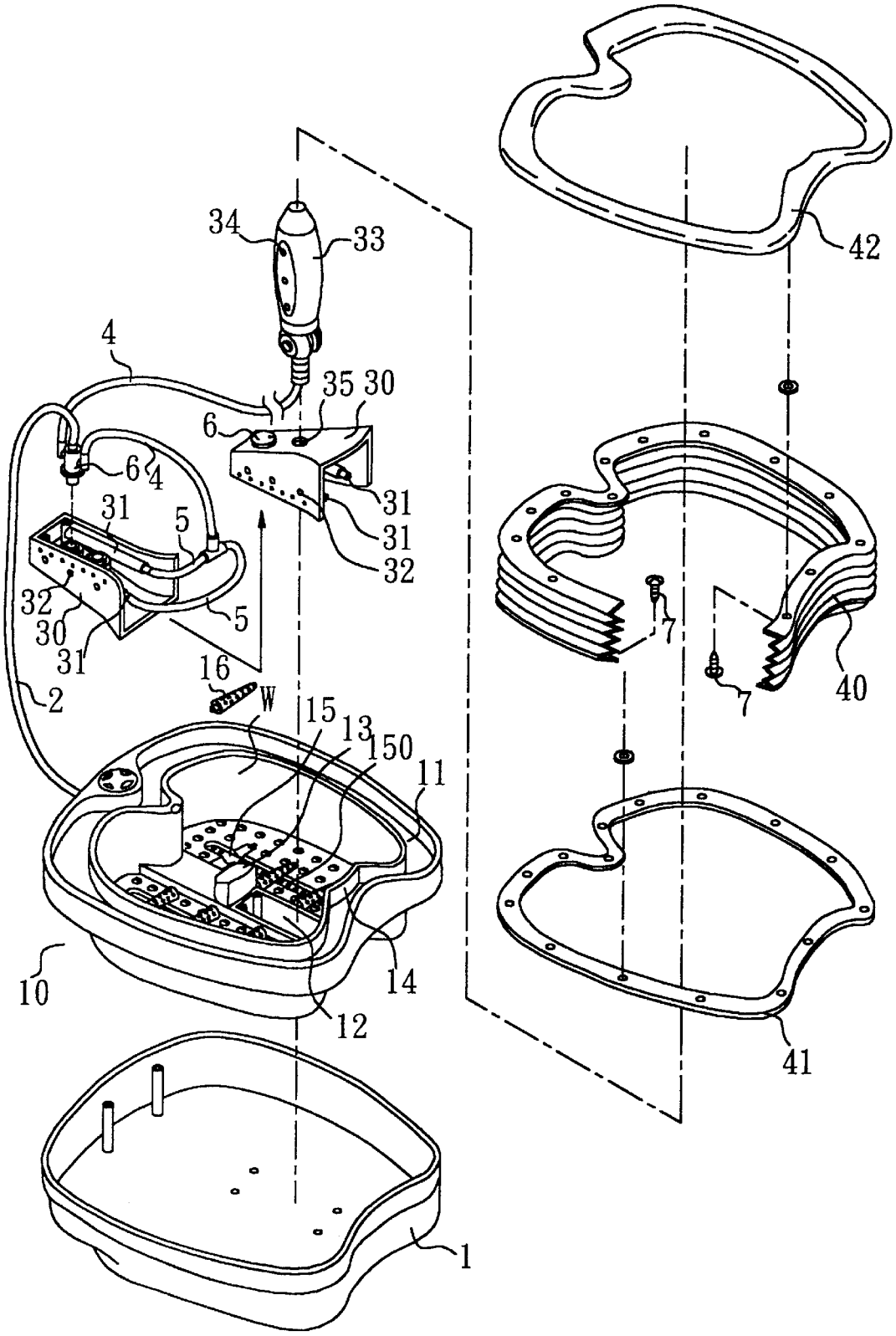
FIG. 1 is an exploded view of a foot spa apparatus according to the present invention.
Figure 2:
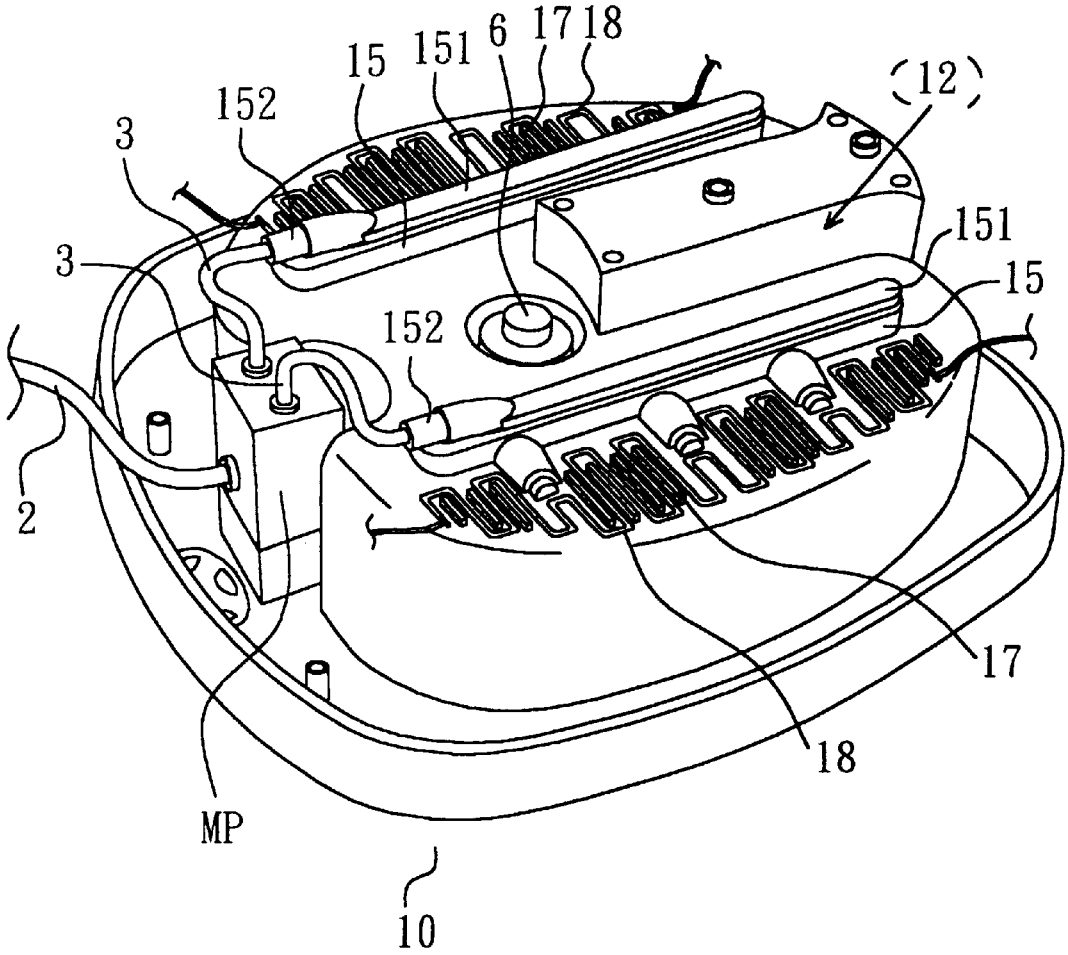
FIG. 2 is a bottom view of the container for the foot spa apparatus according to the present invention.

Referring to FIGS. from 1 through 4, a foot spa apparatus in accordance with the present invention is shown comprising a base 1, a container 10 fixedly provided in the base 1. The container 10 comprises a top water chamber W in which the user's feet are stimulated with jets of hot water, a bottom water chamber 15, a plurality of water return passages 151 disposed at the bottom side below the bottom water chamber 15, a plurality of water holes 150 in fluid communication between the bottom water chamber 15 and the water return passage 151, and a trough 12 fixedly provided into the top water chamber W. An enclosed casing 30 is mounted in the trough 12 and stopped between a front locating block 13 and a rear locating flange 14 of the trough 12. The casing 30 has two spray tubes 31 disposed at two opposite lateral sides. The spray tubes 31 each have jet nozzles 32 though which water is forced out of the spray tubes 31 to stimulate the user's feet in the top water chamber W. A spray control valve 6 is installed in the casing 30 at the top. A water pump MP is provided at the bottom side of the container 10 (see FIG. 2). The water pump MP has its water input side connected to the water return passages 151 through a respective water inlet tube 3 and a water tube connector 152, and its water output side connected to the spray control valve 6 through a water outlet tube 2.

Figure 3A:
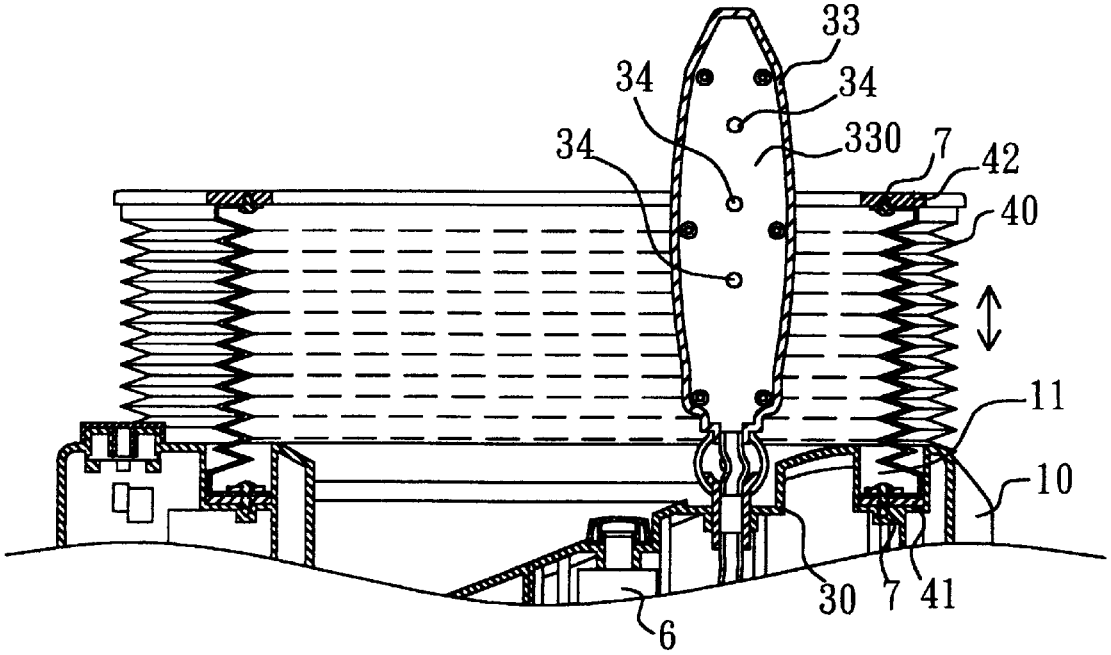
FIG. 3A is a sectional view of the present invention, showing the flexible bellows flange extended out, the auxiliary nozzle tube disposed in vertical.
Figure 3B:
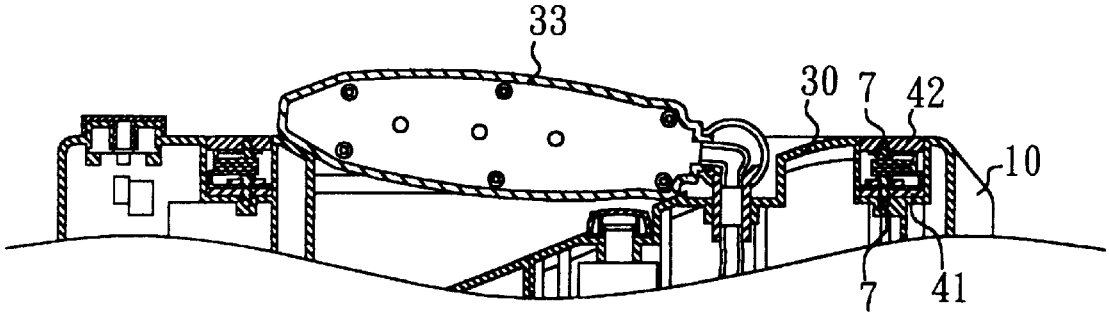
FIG. 3B is another sectional view of the present invention showing the flexible bellows flange collapsed and received within the top peripheral mounting groove of the container, the auxiliary nozzle tube turned to horizontal.
Figure 4:
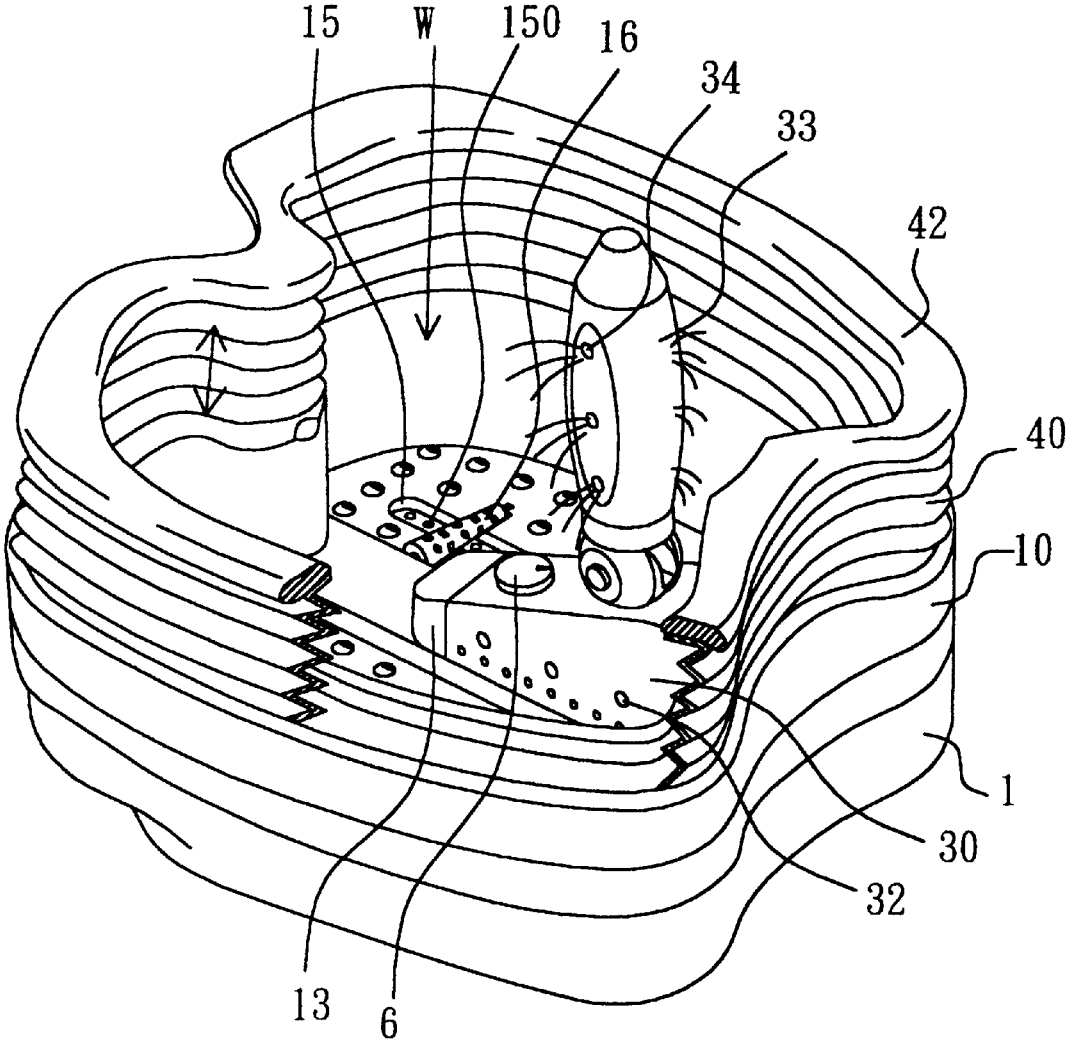
FIG. 4 is a cutaway view of the foot spa apparatus according to the present invention.

The aforesaid arrangement is similar to conventional foot spa apparatus. The main features of the present invention are outlined hereinafter. The container 10 has a top peripheral mounting groove 11 extended around the top water chamber W. A flexible bellows flange 40 is installed in the top peripheral mounting groove 11 of the container 10 and fixedly secured in place by screws 7. A gasket member 41 is mounted in the top peripheral mounting groove 11 and connected between the flexible bellows flange 40 and the container 10. A reinforcing packing member 42 is fixedly fastened to the top of the flexible bellows flange 40 to keep the flexible bellows flange 40 in shape. The flexible bellows flange 40 works as a fence for the top water chamber W, and can be extended or retracted vertically to adjust its height. The casing 30 has a top mounting hole 35. An auxiliary nozzle tube 33 is installed in the top mounting hole 35 of the casing 30 in vertical. Preferably, the auxiliary nozzle tube 33 is hinged to the casing 30, and can be alternatively set between a vertical position as shown in FIG. 3A and a horizontal position as shown in FIG. 3B. The auxiliary nozzle tube 33 has a water pressure accumulation chamber 330, and jet nozzles 34 in fluid communication with the water pressure accumulation chamber 330 at two sides for output of compressed water to stimulate the lower part of the user's legs. Water distribution tubes 4 are respectively connected between the spray control valve 6 and the water pressure accumulation chamber 330 of the auxiliary nozzle tube 33 and between the spray control valve 6 and the pray tubes 31. A rack 17 is provided at the bottom side of the container 10. An electric heating coil 18 is installed in the rack 17 at the bottom side of the container 10, and controlled to heat water in the top water chamber W. Massaging rollers 16 are provided inside the top water chamber W and adapted to massage the sole of the user's feet. When in use, the user can rotate the massaging rollers 16 with the feet, causing the raised portions of the massaging rollers 16 to massage the sole.

When in use, water is filled in the top water chamber W of the container 10. After the user putted the feet in the water in the top water chamber W, the water pump MP is started and the spray control valve 6 is opened. When started, the water pump MP pumps water from the bottom water chamber 15 through water holes 150, the water inlet tubes 3, and the water outlet tube 2 to the water distribution tubes 4 and 5 and then the water spray tubes 31 and the auxiliary nozzle tube 33, enabling compressed water to rush out of the jet nozzles 32 and 34 and to stimulate the sole as well as the lower part of the user's feet. Further, the spray control valve 6 can be controlled to selectively close/open the water passage to the water spray tubes 31 and the auxiliary nozzle tube 33.

Further, the user can adjust the height of the flexible bellows flange 40 subject to the amount of water to be filled in the container 10. If desired, the user can compress the flexible bellows flange 40, keeping the compressed flexible bellows flange 40 received inside the top peripheral mounting groove 11 of the container 10 and kept from sight. The user can also control the electric heating coil 18 to heat the water to the desired temperature level.

Figure 5:
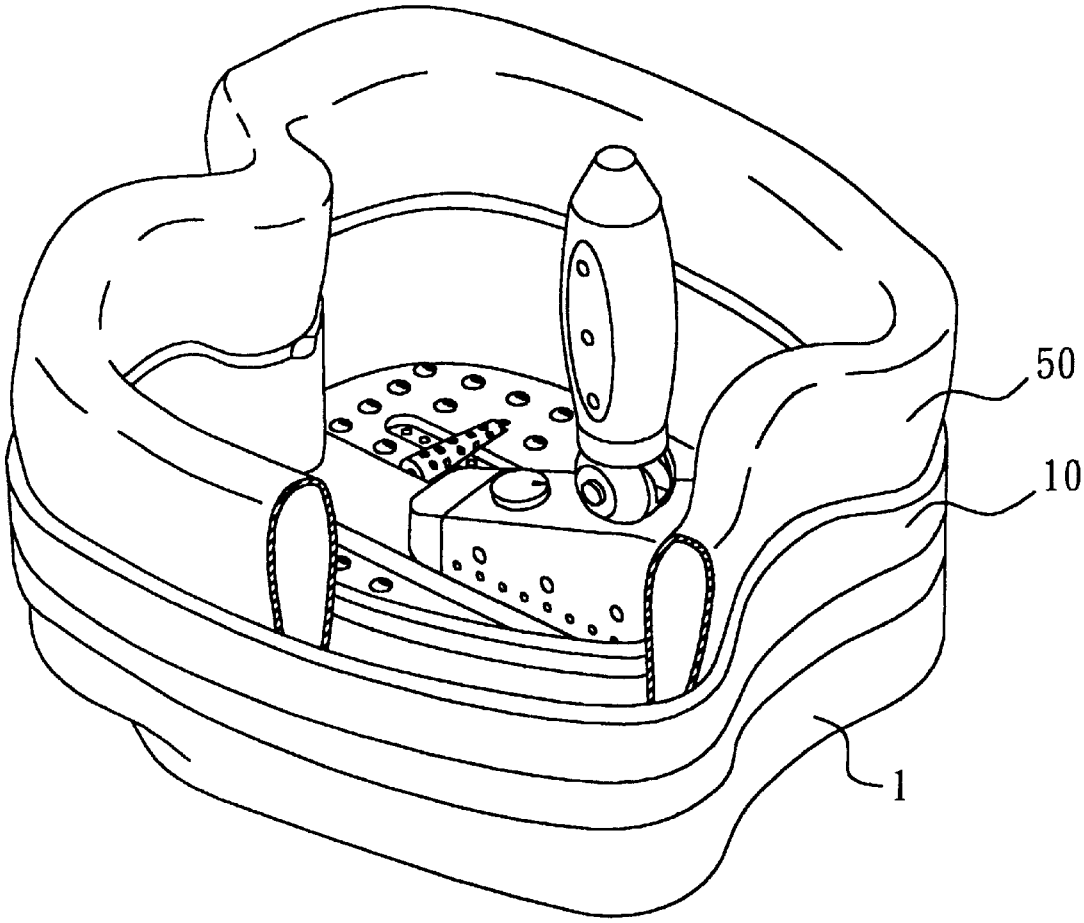
FIG. 5 is a cutaway view of an alternate form of the foot spa apparatus according to the present invention.

FIG. 5 shows an alternate form of the present invention. According to this alternate form, an inflatable fence wall 50 is installed in the top peripheral mounting groove 11 of the container 10. By means of inflating the inflatable fence wall 50 or discharging air from the inflatable fence wall 50, the height of the inflatable fence wall 50 is adjusted.

A prototype of foot spa apparatus has been constructed with the features of FIGS. 1~5. The foot spa apparatus functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A foot spa apparatus comprising:

a base;

a container fixedly provided in said base, said container comprising a top water chamber, a bottom water chamber, a plurality of water return passages disposed at a bottom side below said bottom water chamber, a plurality of water holes in fluid communication between said bottom water chamber and said water return passage, and a trough fixedly provided in said top water chamber;

an enclosed casing mounted in said trough, said casing having two spray tubes disposed at two opposite lateral sides, said spray tubes each having jet nozzles for output of compressed water;

a spray control valve installed in said casing at a top side; and a water pump provided at a bottom side of said container, said water pump having a water input port connected to said water return passages and a water output port connected to said spray tubes through said spray control valve;

wherein said container has a top peripheral mounting groove extended around said top water chamber, a collapsible fence wall installed in said the top peripheral mounting groove;

an auxiliary nozzle tube is hinged to said casing and alternatively set between a horizontal position and a vertical position, said auxiliary nozzle tube having a water pressure accumulation chamber connected to said spray control valve and adapted to receive compressed water from said water pump, and jet nozzles in fluid communication with said water pressure accumulation chamber at two sides for output of compressed water.

2. The foot spa apparatus as claimed in claim 1 wherein said collapsible fence wall is comprised of a flexible bellows flange mounted in the top peripheral mounting groove of said container, a gasket member mounted in the top peripheral mounting groove of said container and connected between said flexible bellows flange and said container, and a reinforcing packing member fixedly fastened to said flexible bellows flange at a top side to keep said flexible bellows flange in shape.

3. The foot spa apparatus as cl aimed in claim 1 wherein said collapsible fence wall is comprised of an inflatable wall body.

4. The foot spa apparatus as claimed in claim 1 further comprising a rack provided at a bottom side of said container, and an electric heating coil installed in said rack and controlled to heat the water in said container.

5. The foot spa apparatus as claimed in claim 1 further comprising a plurality of massager rollers respectively pivoted to the inside of said top water chamber and adapted to massage the sole of the user's feet.

* * * * *